United States Patent [19]

Graves et al.

[11] Patent Number: 4,583,323

[45] Date of Patent: Apr. 22, 1986

[54] HORTICULTURAL APPARATUS FOR ROTATING POTTED PLANTS AND HANGING BASKETS

[76] Inventors: J. W. Graves, Springfield, Tenn. 37172; Harold Tate, Jr.; John U. Cook, both of Cottontown, Tenn. 37048

[21] Appl. No.: 685,059

[22] Filed: Dec. 21, 1984

[51] Int. Cl.[4] ..... A47G 7/02

[52] U.S. Cl. ..... 47/67; 47/39; 248/318

[58] Field of Search ..... 248/318, 346.1, 349, 248/324; 211/115, 116, 144; 108/103, 139, 149; 47/67, 66, 39

[56] References Cited

U.S. PATENT DOCUMENTS

| | | | |
|---|---|---|---|
| 101,918 | 4/1870 | Rogers | 47/39 |
| 119,481 | 10/1871 | Voigt | 211/115 X |
| 739,275 | 9/1903 | Abbe | 211/115 X |
| 2,082,088 | 6/1937 | Wilson | 211/115 X |
| 2,723,763 | 11/1955 | Baldwin | 211/115 X |
| 3,142,269 | 7/1964 | Keck | 108/103 X |
| 3,360,885 | 1/1968 | St. Clair | 47/39 |
| 3,957,242 | 5/1976 | Holtz | 248/318 |
| 4,005,843 | 2/1977 | Wengel | 47/39 |
| 4,026,067 | 5/1977 | Wengel | 47/39 X |
| 4,051,627 | 10/1977 | Schilling, Jr. | 47/39 |
| 4,117,630 | 10/1978 | Kalas | 47/67 |
| 4,189,124 | 2/1980 | Faris | 47/67 X |
| 4,216,619 | 8/1980 | Espy | 47/67 X |
| 4,227,343 | 10/1980 | Espy et al. | 47/67 X |
| 4,238,002 | 12/1980 | Hexamer | 47/67 X |
| 4,266,748 | 5/1981 | Dalton | 108/139 X |
| 4,373,695 | 2/1983 | Faris | 47/67 X |

FOREIGN PATENT DOCUMENTS

| | | | |
|---|---|---|---|
| 6904 | of 1836 | United Kingdom | 47/39 |
| 168493 | 9/1921 | United Kingdom | 211/115 |
| 213507 | of 1924 | United Kingdom | 108/139 |

*Primary Examiner*—Robert A. Hafer
*Assistant Examiner*—Danton DeMille
*Attorney, Agent, or Firm*—Finnegan, Henderson, Farabow, Garrett & Dunner

[57] ABSTRACT

A horticultural apparatus for hanging from an overhead support or resting on a table or the like for rotating plants housed in at least one of a flower pot planter or a hanging basket planter to promote symmetrical growth by allowing more equal exposure of the plant to light, the apparatus comprising a support base, a housing rotatively supported on the support base and having a peripheral support wall with an outwardly extending lip secured about the lower portion of the support wall, rotating apparatus within the support base which communicates with the housing for rotating the housing about the support base, and apparatus detachable from the housing for supporting the flower pot planters or hanging basket planters, wherein the supporting apparatus is positioned about the peripheral support wall and rests on the lip of the housing.

7 Claims, 8 Drawing Figures

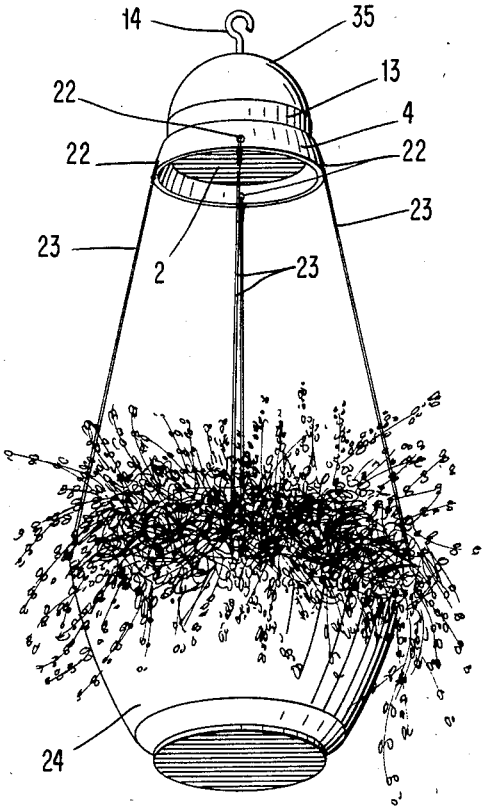
Fig. 4
Fig. 5
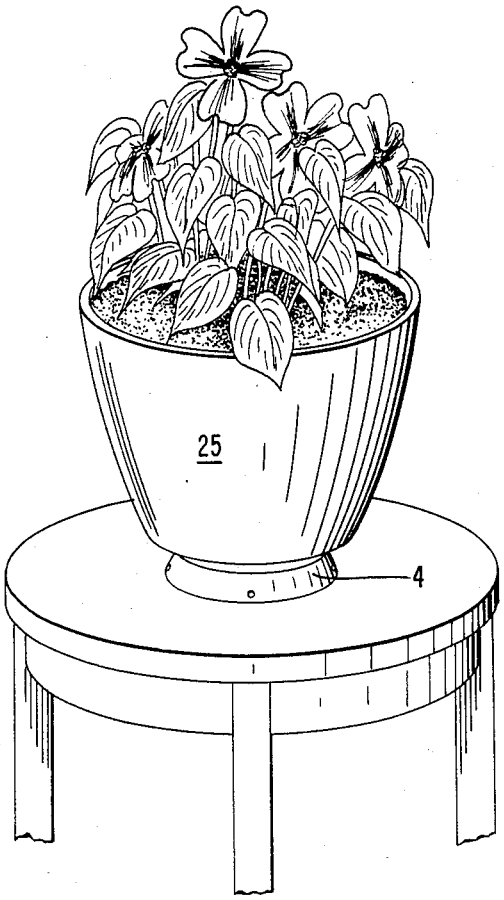
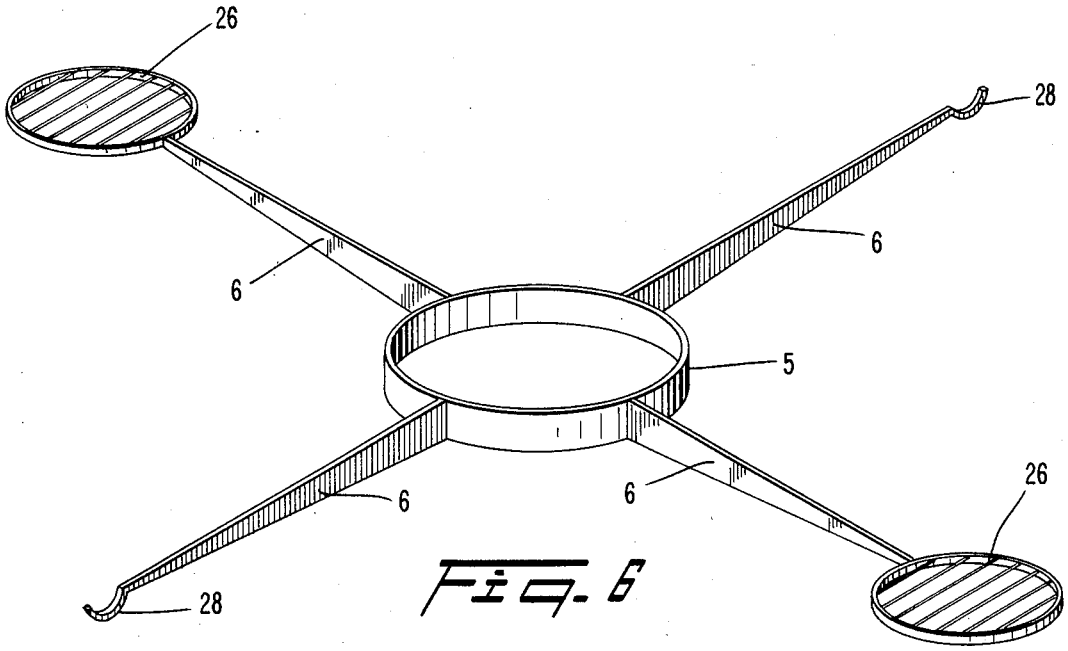
Fig. 6

HORTICULTURAL APPARATUS FOR ROTATING POTTED PLANTS AND HANGING BASKETS

BACKGROUND OF THE INVENTION

1. Field of the Invention

This invention relates generally to the field of horticultural apparatus and more specifically to apparatus for rotating plants housed in at least one of a flower pot planter or a hanging basket planter to promote symmetrical plant growth by successively exposing portions of the plant to light thereby allowing more equal exposure of the plant to the light.

2. Description of the Prior Art

Apparatus for rotating plants housed in a flower pot planter to promote symmetrical plant growth are well-known in the art. One such apparatus is disclosed in U.S. Pat. No. 3,360,885, issued to Maurice W. St. Clair on Jan. 2, 1968. In that patent, a device is disclosed for resting on a horizontal support to rotate a flower pot planter containing plants. Apparatus for rotating plants housed in a hanging basket planter are also known. One such apparatus is disclosed in U.S. Pat. No. 4,117,630, issued to Barbara A. Kalas on Oct. 3, 1978. In that patent, a device is disclosed for suspension from an overhead support to rotate a hanging basket planter.

Although both such apparatus serve the purpose of rotating plants, they are limited to rotating either one flower pot planter or one hanging basket planter but not both types of planters. Furthermore, such apparatus are limited to either resting on a horizontal support (such as a table top or plant stand top) or being suspended from an overhead support.

None of such types of apparatus provides multiple use options in a sinqle unit for:

1. rotating a single flower pot planter with the rotator resting on a horizontal support such as a table top or plant stand top;
2. rotating a plurality of flower pot planters with the rotator resting on a horizontal support or being suspended from an overhead support;
3. rotating a single hanging basket planter with the rotator being suspended from an overhead support;
4. rotating a plurality of hanging basket planters with the rotator being suspended from an overhead support; and
5. rotating a combination of a plurality of flower pot planters and hanging basket planters with the rotator being suspended from an overhead support.

In short, none of the known rotator apparatus provides in one apparatus the ability to rotate both a number of flower pot planters and hanging basket planters from a horizontal resting position or an overhead suspension position.

Due to the limitations of the prior art apparatus, it has been necessary in the past to utilize a number of plant rotators to rotate large numbers of plants housed in flower pot planters. Furthermore, it has been necessary to purchase different types of plant rotators from those for rotating a flower pot planter if a hanging basket was to be rotated. More than one such device for rotating a hanging basket planter was necessary if a large number of baskets were to be rotated. Thus, the noted limitation of the prior art plant rotator apparatus requires a substantial monetary investment if more than one flower pot planter or hanging basket planter are to be rotated.

From the foregoing considerations, it should be apparent that there is a great need for an improved, multiple use plant rotator.

It is, thus, an object of the invention to provide a multiple use horticultural apparatus for rotating plants.

Another object of the invention is to allow a single horticultural apparatus to rotate a plurality of flower pot planters and/or hanging basket planters.

A further object of the invention is to allow a single horticultural apparatus for rotating plants to be hung from an overhead support or supported on a horizontal surface such as a table top or plant stand top.

Still another object of the invention is to eliminate the expense in manufacturing and purchasing a plurality of plant rotators to rotate a plurality of plants housed in flower pot planters and hanging basket planters.

Other objects and features of the present invention will further become apparent hereafter with reference to the accompanying drawings and detailed description of the invention.

SUMMARY OF THE INVENTION

To achieve the foregoing objects and in accordance with the purpose of the invention, as embodied and broadly described herein, the horticultural apparatus for hanging from an overhead support or resting on a table or the like for rotating plants housed in at least one of a flower pot planter or a hanging basket planter comprises a support base having a top, a side, and a connector substantially centered on the top; a housing rotatably supported on the top, including an upper platform having an aperture substantially centered therein and a peripheral support wall attached to and extending downward from the outer perimeter of the platform along the outside of the side a distance less than the vertical length of the side, the aperture being coaxially aligned with the connector for accessing the connector, the support wall including a lower portion; an outwardly extending lip secured about the lower portion of the peripheral support wall; rotating apparatus in the support base communicating with the housing for rotating the housing about the support base; means detachable from the housing for supporting the flower pot planters or hanging basket planters, the supporting means being positioned about the peripheral support wall and resting on the lip; and hanging means, such as an eye bolt, detachably connected to the connector for attaching the base to the overhead support. In a preferred embodiment, the detachable supporting means is a skirt having an upper opening, a lower opening, and a plurality of attaching means, such as apertures, spaced equidistantly about the skirt for supporting the flower pot planter or hanging basket planter; or a collar having a plurality of arms extending therefrom spaced equidistantly about the collar for supporting the flower pot planters and hanging basket planters; or a shell having a closed end and including an attaching means (such as a hook) at the closed end for holding a hanging basket planter, and an opening opposite the closed end defined by a perimeter which includes a plurality of securing means, such as swing latches, for attaching the shell to the top of the lip.

BRIEF DESCRIPTION OF THE DRAWINGS

The accompanying drawings, which are incorporated in and constitute a part of this specification, illustrate several embodiments of the invention and, together with the description, serve to explain the principles of the invention.

Of the drawings:

FIG. 4 is a perspective view of the support base, rotating housing, and skirt of a preferred embodiment of the invention being used to rotate a hanging basket planter.

FIG. 5 is a perspective view of the support base, rotating housing, and skirt of a preferred embodiment of the invention being used to rotate a flower pot planter.

FIG. 6 is a perspective view of another of the detachable supporting means being a collar with extending arms to be used with the support base and rotating housing illustrated in FIGS. 1 and 2.

DESCRIPTION OF THE PREFERRED EMBODIMENT

Reference will now be made in detail to the present preferred embodiment of the invention, an example of which is illustrated in the accompanying drawings.

In accordance with the invention, a horticultural apparatus for hanging from an overhead support or resting on a table or the like for rotating plants housed in at least one of a flower pot planter or a hanging basket planter includes a support base having a top, a side, and a connecting means substantially centered on the top; a housing rotatably supported on the top, including an upper platform having an aperture substantially centered therein and a peripheral support wall attached to and extending downward from the outer perimeter of the platform along the outside of the side a distance less than the vertical length of the side, the aperture being coaxially aligned with the connecting means for accessing the connecting means, the support wall including a lower portion. The horticultural apparatus further includes an outwardly extending lip secured about the lower portion of the peripheral support wall; rotating means in the support base, communicating with the housing for rotating the housing about the support base; means detachable from the housing for supporting the flower pot planters or hanging basket planters, the supporting means being positioned about the peripheral support wall and resting on the lip; and hanging means detachably connected to the connecting means for attaching the base to the overhead support.

Figure 1:
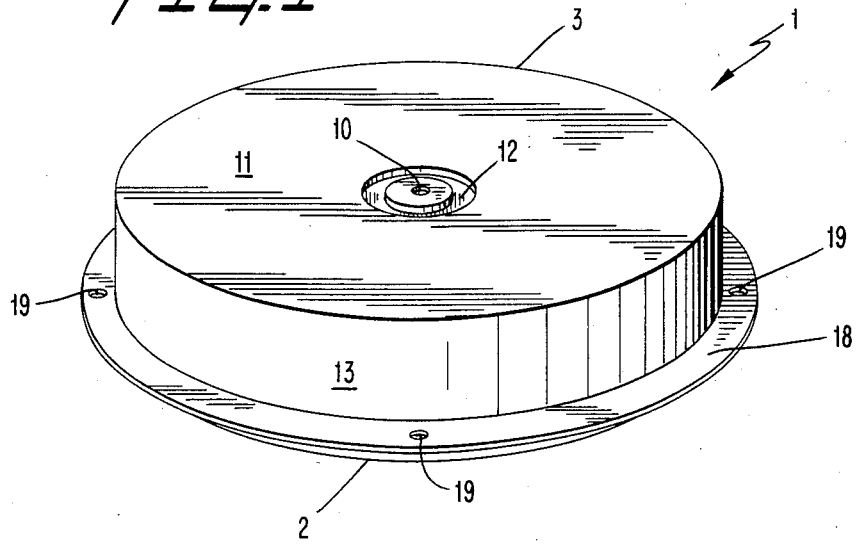
FIG. 1 is a perspective view of the support base and rotating housing portion of a preferred embodiment of the invention.
Figure 2:
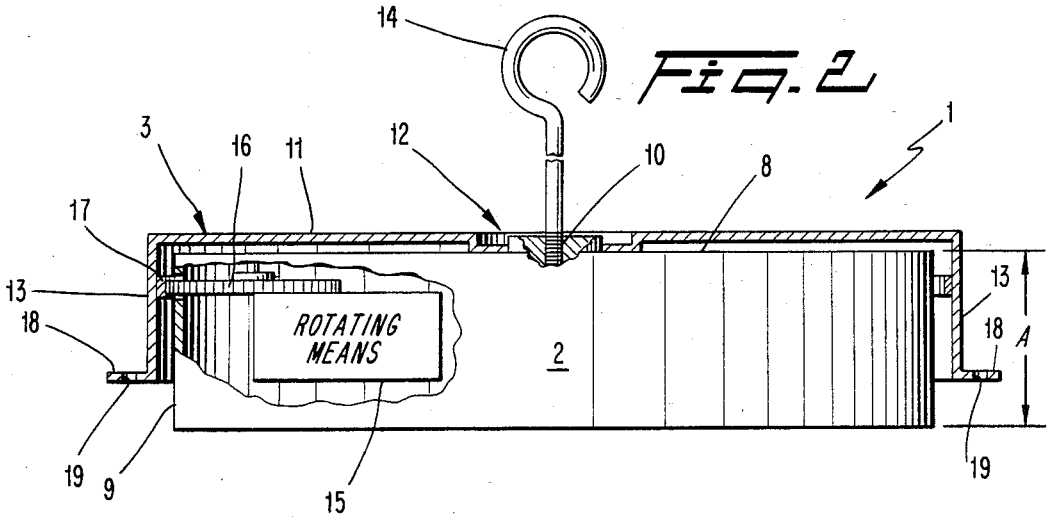
FIG. 2 is a sectional view of the support base and rotating housing portion of the invention shown in FIG. 1 with the eye-bolt hanging means in place.
Figure 3:
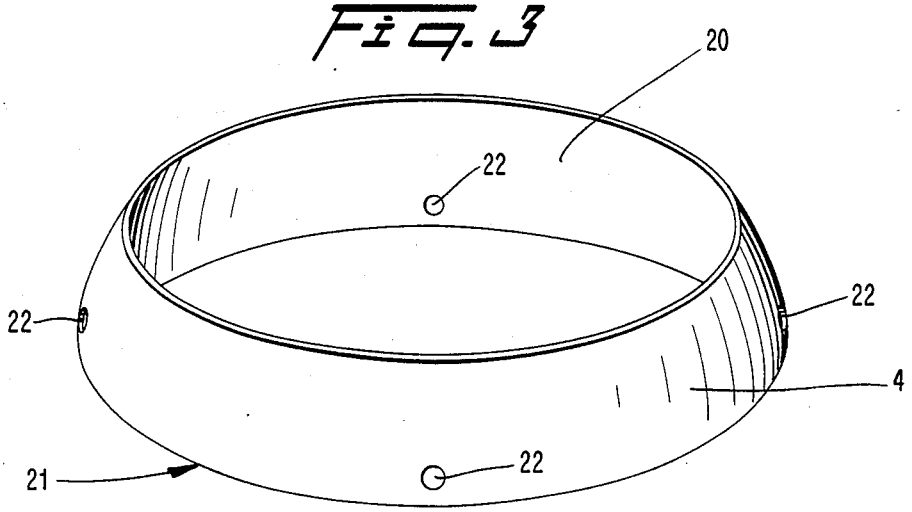
FIG. 3 is a perspective view of one of the detachable supporting means being a skirt to be used with the support base and rotating housing illustrated in FIGS. 1 and 2.
Figure 7:
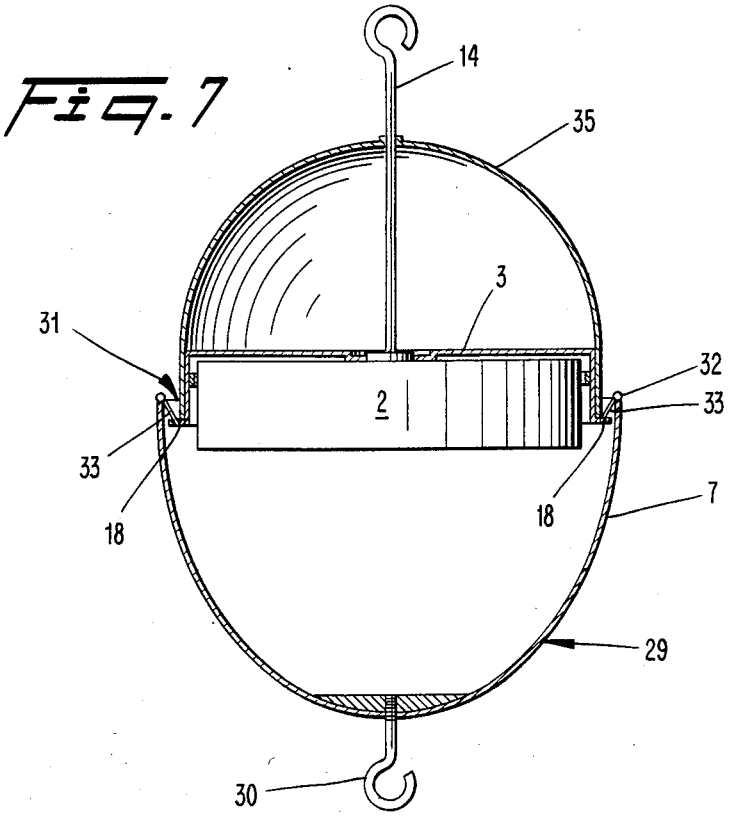
FIG. 7 is a sectional view of another of the detachable supporting means being a shell to be used with the support base and rotating housing illustrated in FIGS. 1 and 2.
Figure 8:
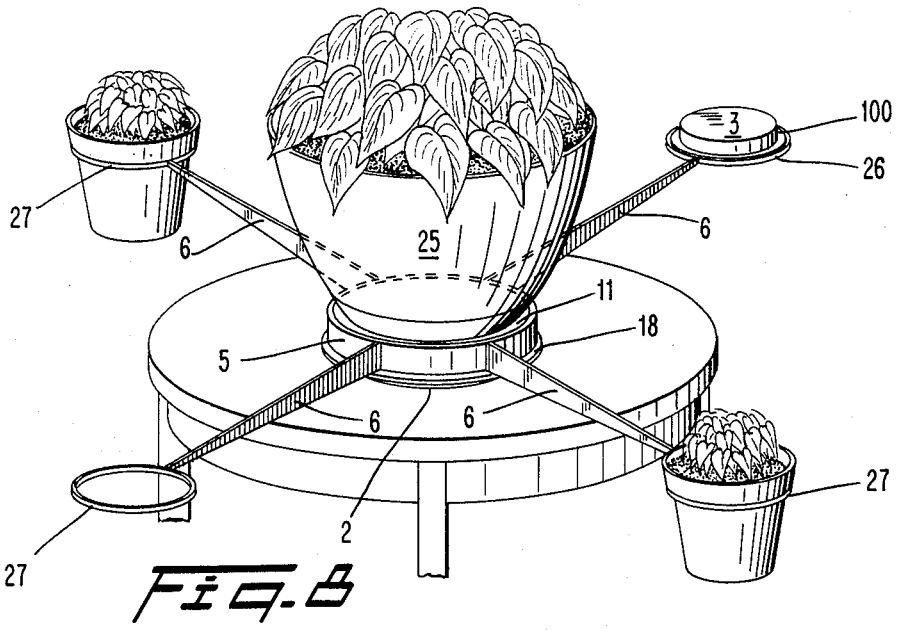
FIG. 8 is a perspective view of the support base and rotating housing of FIGS. 1 and 2 and the collar of FIG. 6 of a preferred embodiment of the invention resting on a horizontal surface for rotating a plurality of flower pot planters.

Referring now to the drawings, wherein like reference characters designate like or corresponding parts throughout the several views, there is shown a preferred embodiment of the invention comprising main unit 1 having support base 2 and rotating housing 3 as illustrated in FIGS. 1 and 2 and detachable supporting means, such as skirt 4 as illustrated in FIGS. 3–5, collar 5 having arms 6 as illustrated in FIGS. 6 and 8, and shell 7 as illustrated in FIG. 7.

As will become evident from the following description, main.unit 1 can be used to rotate plants by resting the support base on a horizontal surface such as a table top or plant stand top and placing plants in flower pot planters or hanging basket planters on top of rotating housing 3. Main unit 1, when used in conjunction with skirt 4, can be suspended from an overhead support to rotate plants in a hanging basket planter. Furthermore, main unit 1 can rest on a horizontal surface or be suspended from an overhead support and used with collar 5 to rotate a plurality of flower pot planters or hanging basket planters. Additionally, main unit 1 may be suspended from an overhead support and used with shell 7 to support and rotate a hanging basket planter.

As illustrated in FIGS. 1 and 2, support base 2 of main unit 1 includes top 8, side 9, and connecting means, such as a threaded cavity 10 or the like, substantially centered on top 8. Rotating housing 3 is rotatably supported on top 8 of base support 2 by well-known means (not illustrated) such as roller bearings, bushings, or the like.

Rotating housing 3 includes upper platform 11 with aperture 12 substantially centered therein and peripheral support wall 13 attached to and extending downward from the outer perimeter of platform 11 along the outside of side 9. Wall 13 extends downward along the outside of side 9 a distance less than the vertical length A of side 9 as shown in FIG. 2. Aperture 12 is coaxially aligned with the connecting means for allowing access to the connecting means through upper platform 11 of rotating housing 3 as shown in FIGS. 1 and 2. The purpose for the connecting means, such as threaded cavity 10, is to accept hanging means such as eye-bolt 14 shown in FIG. 2 for attaching support base 2 to an overhead support as will be fully discussed below.

Rotating housing 3 of main unit 1 is rotated about support base 2 by rotating means 15 positioned within support base 2 as illustrated in block diaqrammatic form in FIG. 2. Rotating means 15 can be any of a number of known electrically powered or mechanically powered motors geared to provide a rotational output of fixed rotational speed or variable rotational speed. As shown in FIG. 2, rotating means 15 rotates main drive gear 16 which meshes with internal bull gear 17 of rotating housing 3 through a small opening in side 9 of support base 2. Internal bull gear 17 is secured about the internal circumference of peripheral support wall 13. Access to rotating means 15 can be by an access door (not illustrated) in the bottom of support base 2 of main unit 1.

Operating rotating means 15, the output rotation of which is communicated to rotating housing 3 of main unit 1, provides timed rotation to housing 3 in relation to support base 2. The rotation of housing 3 in relation to support base 2 occurs regardless of whether support base 2 is supported from a horizontal surface as shown in FIG. 8, for example, or suspended from an overhead support as shown in FIG. 7, for example.

Secured about the lower portion of peripheral support wall 13 is an outwardly extending lip 18 clearly shown in FIGS. 1, 2, and 7. It is preferred that lip 18 extend outwardly from wall 13 at a 90 degree angle to form an L-shaped cross section as shown in FIG. 2.

A plurality of apertures 19 may be positioned in lip 18 as shown in FIGS. 1 and 2. Apertures 19 can be utilized for connecting tethers running from a hanging flower pot planter or hanging basket planter to rotating housing 3. In this configuration, when main unit 1 is suspended from an overhead support, the planter connected to the tethers will be rotated when rotating means 15 is activated to impart rotation of housing 3 about support base 2.

Due to the configuration of the above-described main unit 1 with outwardly extending lip 18 being secured about the lower portion of peripheral support wall 13 of housing 3, a number of detachable supporting means may be utilized in conjunction with main unit 1 to support and rotate one or more flower pot planters and hanging basket planters. Preferably, the detachable supporting means are skirt 4, collar 5 with arms 6, and shell 7 as illustrated in FIGS. 3, 6, and 7, respectively. Each of these detachable supporting means can be positioned about peripheral support wall 13 to rest on outwardly extending lip 18 as shown in FIGS. 4, 7, and 8.

As shown in FIG. 3, skirt 4, preferably made of a rigid materia1, has upper opening 20 defined by the top of skirt 4, lower opening 21 defined by the bottom of skirt 4, and a plurality of attaching means, such as apertures 22, hooks (not illustrated), or the like, spaced equidistantly about skirt 4 for supporting tethers leading to a flower pot planter or hanging basket planter. For example, as illustrated in FIG. 4, tethers 23 connect hanging basket planter 24 to skirt 4 at apertures 22. When the hanging means, for example eye-bolt 14, is attached to connecting means 10 of support base 2 and then attached to an overhead support, hanging basket planter 24 will rotate upon the activation of rotating means 15 housed in support base 2 to promote symmetrical plant growth of the plant in planter 24 by promoting more equal exposure of the plant to sunlight or artificial light.

Skirt 4 is constructed so that lower opening 21 defines an area larger than the area defined by the outer perimeter of lip 18 and the area of upper opening 20 is smaller than the area defined by the outer perimeter of lip 18 but larger than the area defined by the outer perimeter of peripheral support wall 13. This construction allows the bottom of skirt 4 to slide over upper platform 11 while upper opening 20 defined by the top of skirt 4 fits over upper platform 11 but engages lip 18 so that skirt 4 is supported by housing 3 and rotated with housing 3 upon activation of rotating means 15. This configuration is shown in FIG. 4 as briefly discussed above.

As illustrated in FIG. 5, when main unit 1 is placed on a table top, plant stand, or other horizontal support, skirt 4 rests on the horizontal surface and acts as an aesthetic cover to hide main unit 1 from view. In this configuration, flower pot planter 25 is placed on upper platform 11 of housing 3 for rotation to expose the plant to more equal amounts of light for promoting symmetrical growth of the plant.

A second detachable supporting means of the invention is collar 5 with arms 6 illustrated in FIGS. 6 and 8. Collar 5 is made of a rigid material, such as plastic or metal, and configured to slide over upper platform 11 and about peripheral support wall 13. The bottom of collar 5 rests on outwardly extending lip 18 of housing 3 for support. Two or more arms 6 extend from collar 5 and are spaced equidistantly about the collar. At the end of each arm 6 positioned away from collar 5 are means for supportinq flower pot planters and/or hanging basket planters. Such supporting means can be a platform on which a flower pot planter may be placed such as platform 26 illustrated on two arms of collar 5 illustrated in FIG. 6. These supporting means may also be a band, such as band 27 shown in FIG. 8 in which a flower pot planter may be placed. The supporting means may also be hooks 28 as shown in FIG. 6 for holding tether lines to hanging basket planters or flower pot planters (not illustrated). Combinations of supporting means 26, 27, and 28 can be used in conjunction with one collar 5 as desired. As illustrated in FIG. 8, when collar 5 is placed about housing 3 and supported by lip 18, support base 2 may be placed on a table or plant stand top or the like and flower pot planters placed at the ends of arms 6 and flower pot planter 25 placed on top of upper platform 11 of rotating housing 3 to rotate a multiplicity of planters and plants.

As also shown in FIG. 8, main unit 100, which is constructed in the same manner as main unit 1 and which may be the same size or a smaller version of main unit 1, is placed at the end of arm 6 on platforms 26. A flower pot planter (not illustrated) is positioned on the upper platform of rotating housing 3 of each main unit 100 so that when main unit 100 is operated, it provides rotation of the flower pot planter located on it in relationship to its arm 6 and, of course, the entire arm is rotated about support base 2 of main unit 1. This multiple use of main units promotes equal exposure of the plant to light.

While not illustrated, the main unit and collar configuration of FIG. 8 may be suspended from an overhead support by removing flower pot planter 25 and inserting the threaded end of eye-bolt 14 into the threaded cavity 10 as shown in FIG. 2 and eye-bolt 14 hung from an overhead support.

Another preferred detachable supporting means of the invention is illustrated in sectional view in FIG. 7. The detachable supporting means of FIG. 7 is shell 7. Shell 7 has closed end 29 which includes an attaching means, such as a hook 30 or the like, for supporting the tether lines of a hanging basket planter (not illustrated). Shell 7 has opening 31 opposite closed end 29 defined by perimeter 32 of shell 7. Attached to or included in perimeter 32 is a plurality of securing means 33 for attaching shell 7 to the top of lip 18 on rotating housing 3.

Securing means 33 are located about perimeter 32 and, preferably, equidistantly spaced apart thereon. Opening 31 is larger than the area defined by the outer perimeter of lip 18 so that perimeter 32 of shell 7 may slide up over lip 18 thus allowing securing means 33 to engage the top of lip 18 thereby securing shell 7 to rotating housing 3. Securing means 33 may be swing latches 34, as illustrated in FIG. 7, pivotably connected to perimeter 32 of shell 7 so that they may pivot down along the inside of shell 7 until perimeter 32 is positioned up over lip 18. At that time, swing latches 34 are pivoted away for a limited degree from the inner wall of shell 7 to engage the top of lip 18. Securing means 33 may also be spring clips (not illustrated) mounted about perimeter 32 so that the perimeter may slide up over lip 18 in such a manner that the spring clips snap out to engage the top portion of lip 18.

As shown in FIG. 7, support base 2 is supported from an overhead by eye-bolt 14 so that a hanging basket planter may be attached to the attaching means for rotation. As also shown in FIG. 7, upper shell 35 can be positioned on rotating housing 3 for appearance sake.

Upper shell 35, if used, must be able to rotate freely about eye-bolt 14. Such an upper shell can also be used in the configuration illustrated in FIG. 4.

The operation of the present invention should be easily understood by one skilled in the art from the above description. In all configurations of operation, main unit 1 is utilized to provide desired rotational movement for plant growth enhancement. Additionally, main unit 1 may be used alone or with skirt 4 added for appearance sake (as shown in FIG. 5) to rotate a single flower pot planter when the planter is placed on upper platform 11 and main unit 1 rests on a horizontal support such as a table top or plant stand top. Main unit 1 can be used with collar 5 and arms 6 to rotate a plurality of flower pot planters when main unit 1 rests on a horizontal support as shown in FIG. 8 or when it is hung from an overhead support. Additionally, main unit 1 when used in conjunction with shell 7 will rotate a single hanging basket planter when main unit 1 is suspended from an overhead support as shown in FIG. 7. Main unit 1 can be used with collar 5 and arms 6 to rotate a plurality of hanging basket planters and/or flower pot planters when main unit 1 is suspended from an overhead support. Additionally, main unit 1 may be used with skirt 4 to rotate a hanging basket planter when main unit 1 is supported from an overhead support. Additionally, plant rotation can be enhanced by utilizing main unit 100's at the end of arms 6 of collar 5 which is rotated by main unit 1 suspended from an overhead support or resting on a table top or the like.

Obviously, many modifications and variations of the present invention are possible in light of the above teachings. For example, both shell 7 and collar 5 with arms 6 may be engaged with rotating housing 3 to rotate a plurality of flower pot planters and/or hanging basket planters when main unit 1 is suspended from an overhead support. Therefore, it is to be understood that, within the scope of the appended claims, the invention may be practiced otherwise than as specifically described.

What is claimed:

1. A horticultural apparatus for rotating plants housed in at least one of a flower pot planter and a hanging basket planter, said apparatus comprising:

a support base having a top, a side, and a connecting means substantially centered on said top;

a housing rotatably supported on said top, including an upper platform having an aperture substantially centered therein and a peripheral support wall attached to and extending downward from the outer perimeter of said platform along the outside of said side a distance less than the vertical length of said side, said aperture being coaxially aligned with said connecting means for accessing said connecting means, said support wall including a lower portion;

an outwardly extending lip secured about said lower portion of said peripheral support wall;

rotating means in said support base, communicating with said housing for rotating said housing about said support base;

means detachable from said housing for supporting said flower pot planters and hanging basket planters, said supporting means being positioned about the peripheral support wall and resting on said lip; and hanging means detachably connected to said connecting means for attaching said base to an overhead support.

2. The horticultural apparatus of claim 1 wherein said detachable supporting means includes a skirt having a top portion, an upper opening defined in said top portion, a lower opening, and a plurality of attaching means spaced equidistantly about said skirt for supporting said flower pot planter and hanging basket planter, said lower opening being larger than the area defined by the outer perimeter of said lip and said upper opening being smaller than said area for engaging said top portion of said skirt and said lip.

3. The horticultural apparatus of claim 1 wherein said detachable supporting means includes a collar having a plurality of arm means extending therefrom, said arm means being spaced equidistantly about said collar for supporting said flower pot planters and said hanging basket planters.

4. The horticultural apparatus of claim 1 wherein said detachable supporting means includes a shell having a closed end, and including an attaching means at said closed end for holding a hanging basket planter, and an opening opposite said closed end defined by a perimeter, said perimeter including a plurality of securing means for attaching said shell to the top of said lip.

5. The horticultural apparatus of claim 4 wherein said securing means includes a plurality of swing latches.

6. The horticultural apparatus of claim 1 wherein said hanging means includes an eye-bolt threaded on one end thereof, and said connecting means includes a threaded cavity for receiving the threaded end of said eye-bolt.

7. The horticultural apparatus of claim 2 wherein said attaching means includes a series of apertures.

* * * * *